US009518798B1

(12) United States Patent
Farren

(10) Patent No.: US 9,518,798 B1
(45) Date of Patent: Dec. 13, 2016

(54) ARCHERY BOW BRAKE

(71) Applicant: Jon P. Farren, Boise, ID (US)

(72) Inventor: Jon P. Farren, Boise, ID (US)

( * ) Notice: Subject to any disclaimer, the term of this patent is extended or adjusted under 35 U.S.C. 154(b) by 0 days.

(21) Appl. No.: 14/937,555

(22) Filed: Nov. 10, 2015

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01); *F41B 5/105* (2013.01)

(58) Field of Classification Search
CPC ..... F41B 5/10; F41B 5/123; F41B 5/14
See application file for complete search history.

(56) References Cited

U.S. PATENT DOCUMENTS 4,294,221 A 10/1981 Bryant
4,471,747 A * 9/1984 Nishioka ..... F41B 5/10 124/23.1
4,886,039 A 12/1989 Wagner
5,000,154 A 3/1991 Slayton
5,002,035 A 3/1991 Brooks
5,092,309 A * 3/1992 Beaton ..... F41B 5/10 124/25.6
5,146,908 A 9/1992 Larson
5,465,705 A 11/1995 Baeseman
5,967,131 A * 10/1999 Hervig ..... F41B 5/1403 124/25.6
6,032,660 A 3/2000 Hervig

* cited by examiner

*Primary Examiner* — John Ricci

(57) ABSTRACT

What is disclosed is a braking mechanism for holding a bow string at full draw or any partial draw position along the entire length of the draw stroke. The braking mechanism functions by imparting friction onto the string of a compound archery bow thereby preventing the string from moving or being wound out of or into a cam of the compound archery bow.

19 Claims, 3 Drawing Sheets

ARCHERY BOW BRAKE

TECHNICAL FIELD

The presently disclosed technology relates to the field of archery equipment, and more particularly to a brake system for a compound archery bow.

BACKGROUND

Compound archery bows have become very popular for hunting and target shooting in recent years. These bows use a bowstring stretched between one or two cams. There are a variety of orientations of bowstrings, cams/pulleys, and (on some bows) cables, of which one or more types of bows is discussed herein as an example. It is thought that the inventive concepts discussed herein can be utilized on any compound archery bow, regardless of the orientation of the pulley(s), cables, cam(s), and/or bowstring while still utilizing the inventive concept herein. For this reason, the term, bowstring, refers herein to a single bowstring and/or a bowstring with one or more cables in addition to a bowstring connecting the cam(s) and/or pulley(s). The cams are attached to two limbs of the bow. The limbs of the bow are attached to a bow riser that typically has an arrow rest, a sight, and a grip for a user to grasp the handle of the bow. The bow riser and limbs typically are in an arch like formation with the bow strings stretching in between the two distal ends of the limbs from the cams and/or pulleys. In a dual cam bow there is a cam at each end of the limbs. In a single cam bow there is a cam typically at the lower limb and an idler pulley at the upper limb. Additionally, on some bows, stretched between the cam(s) and the pulley(s) is one or more cables, typically referred to as a cable. When the bow string is drawn back, the cams and pulleys rotate as the string winds out of the cams and the distal ends of the limbs are pulled closer together. As the bow string is being drawn, the draw weight or force applied to the string increases to a peak draw weight and reduces to a lower draw weight at the full draw position due to the eccentric geometry of the cams. This reduction in draw weight is known as a valley or draw weight let-off. When the drawn string is released, the string is wound back into the cams and the limbs rebound or retract outward imparting the energy stored in the limbs into the string.

Several different inventions have been developed to allow the user to stop the string from being released when the bow is at full draw. Typically these inventions involve placing some type of object in between the bow string and the bow riser to hold the bow string at a full draw position thus relieving a user from any further manual effort to retain the bowstring at full draw. An example of such a system is found at U.S. Pat. No. 4,886,039. However, systems that allow a user to hold a bow at full draw without manual effort typically do not allow a user to relieve some of the manual effort required to hold a bow at partial draw. The importance behind allowing a user to hold a bow at partial draw is illustrated in a hypothetical in which a user is hunting an animal such as a deer. The user generally waits until the deer is either not looking directly at the bow user or for when the deer's view of the bow user is obstructed by an object such as a tree. The bow user (or bow hunter) tries to remain still while in the animal's view because the animal is more likely to see the bow user if the bow user is moving while the animal is looking at the bow user. The user draws the bow string toward shooting position and if the deer (or other animal) looks at the user while the user is drawing the bowstring back, the bow user can stops drawing the bowstring further back and holds the bowstring at whatever draw position the bow string is at. This can be difficult, particularly in a bow with a high draw weight. When the deer (or other animal) is no longer looking toward the bow user, the user then draws the bow string further toward the fully drawn position. This starting and stopping of drawing of the bow string can occur multiple times depending on the behavior of the deer (or other animal) until the bow and bow string reach a fully drawn position from which the user can shoot the bow with maximum speed and energy. The user can also draw, hold and release the string to shoot the arrow from any partial draw position, thereby not requiring the user to draw and hold the string in the full draw position before shooting.

Pulley braking systems, as depicted in U.S. Pat. No. 6,032,660 have been developed that impart friction onto the pulley or cam of the bow system and lower the amount of force a user must place on the bow to hold the bow at partial draw or full draw. Although these pulley braking systems allow the user to retain the bow at partial or full draw with less force, the pulleys are located on the limb(s) of the bow, and thus the brake caliper of the pulley braking system is also located on the limb(s) of the bow. Positioning the braking system on the limbs of the bow increases the weight of the limbs, which in turn reduces the amount of force that a rebounding or recoiling limb can impart on the bowstring when the bowstring is released from full draw. What is needed is a device that allows a user to reduce or relieve tension needed to hold the bow string at partial or full draw position while maintaining a higher performance out of the bow.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a compound archery bow having a string and/or cable brake system. The compound archery bow has a riser having two limbs and at least one cam rotatably mounted on one of the limbs. A bowstring is strung between the limbs. The bowstring is windably connected with the cam in a single cam bow or windably connected to two cams on opposing limbs of a dual cam bow. The bow is configured such that when a user draws the bowstring toward full draw, the bowstring rotates the cam causing the string to be wound out of the cam. The brake of the compound archery bow has a brake actuation mechanism and a string friction mechanism. Wherein said string friction mechanism is positioned near or around the string. In a preferred embodiment, actuation of said brake actuation mechanism actuates the friction mechanism to impart friction onto said string preventing said string from being wound in said cam(s).

In a preferred embodiment the string friction mechanism is a caliper having two opposing brake pads. The caliper is attached to the bow such that the string is located between the two opposing brake pads of the caliper. Actuation of the brake actuation mechanism biases the opposing brake pads toward one another thus applying friction on the string between the two brake pads. This mechanism is similar to a disc brake system as commonly found in bicycles or motorized vehicles.

In a preferred embodiment, the brake actuation mechanism is a depressible lever handle or trigger. Depression of the lever handle actuates the string friction mechanism. Preferably the lever handle is positioned on the bow riser in front of the grip section of the bow handle. This allows a user to actuate the braking mechanism with the hand that the user has positioned on the grip section when drawing the bowstring. The brake actuation mechanism can be connected to the string friction mechanism by a variety of mechanisms including, but not limited to, a hydraulic brake line, a mechanical brake line, by electrical signal from the actuation mechanism to the braking mechanism, or by a wireless signal transmitted between the brake mechanism and the braking mechanism.

In a preferred embodiment, the brake pads of the caliper mechanism are biased apart in a resting, or non actuated position. Actuation of the brake presses the brake pads together, either hydraulically or by a mechanical function such as a spring or electrically similar to electric brakes. This type of caliper is commonly known in the art of bicycle brakes or vehicular brakes. In an alternate embodiment, the brake is configured such that brake pads are biased toward one another impacting friction on the string at a resting or primary position. Depression of the lever handle releases the brake pads from said biased position to release friction on said string, thus allowing a user to draw the bow back. This allows the bow brake to function as a safety device.

In a preferred embodiment the caliper of the brake is attached to the bow riser by an attachment device that typically extends from the riser toward the bowstring. The attachment mechanism can be attached to the riser in a variety of ways, preferably in a location that does not interfere with the normal travel of the bowstring or arrow when released from a drawn position.

Still other features and advantages of the presently disclosed and claimed inventive concept(s) will become readily apparent to those skilled in this art from the following detailed description of preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE PREFERRED EMBODIMENTS

Figure 1:
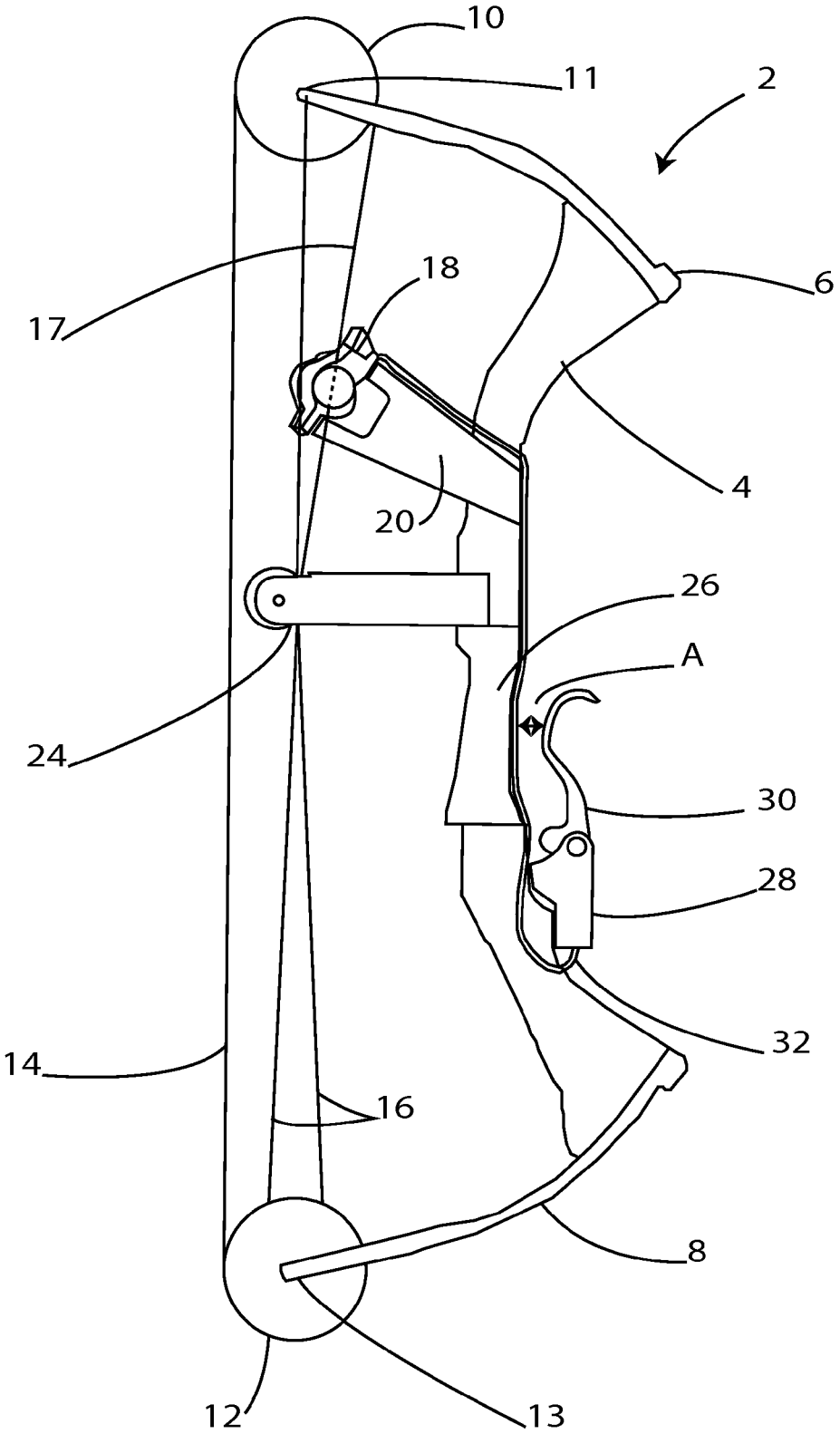
FIG. 1 is a perspective view of a compound bow including an embodiment of the present invention.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Referring now to the drawings in FIG. 1 there is illustrated a compound bow having an embodiment of the invention positioned on compound archery bow 2. The bow 2 has bow riser 4 between an upper limb 6 and a lower limb 8. At the distal ends 11, 13 of the upper 6 and lower 8 bow limbs are located two cams 10, 12 in a dual cam bow or a single cam 12 and an idler pulley 10 in a single cam bow. A bow string 14 stretches between the cams or pulleys. String or cables 16 also stretch between the cams or pulleys. In the depicted embodiment, the string or cables are retained together at cable retainer 24. The braking device of the present invention includes caliper 18 located on one of the two cables 17. String 17 runs between the brake pads of the caliper. The caliper is attached to a brake actuating device 28 by cable 32. Cable 32 can be hydraulic, mechanical or electrically connected. Alternatively, the brake actuator and the brake device can be wirelessly connected. In the depicted embodiment, the brake is actuated by depression of lever handle 30 located proximate to the grip 26 of the bow which actuates brake caliper 18 that is attached to the bow by mounting bracket 20. The pressure of lever handle 30 causes the brake pads within caliper 18 to push together to impact friction on to the string 17 thus preventing string 17 from moving. When the bow is in a drawn position, the string 16 are wound out of one or both of the cams. Winding of the string(s) out of the cam(s) retracts the distal ends of the limbs 11, 13 toward one another. Retraction of the limbs allows for the energy built up in the drawing of the bow string to be stored in the flexing of the limbs. When the bow string is released, the cams rotate back and the bow limbs are propelled outwards due to the stored energy in the bow limbs, thus accelerating the speed at which the bowstring travels forward propelling the arrow. When the bow braking device is engaged, the friction upon the string prevent the string from being released which prevents the cams from turning and the bow limbs from propounding away from one another, and thus preventing the energy stored in the bow limbs to be transferred to the retracting bow string. The depression distance of the brake lever 30 is depicted in the diagram by distance A.

Figure 2:
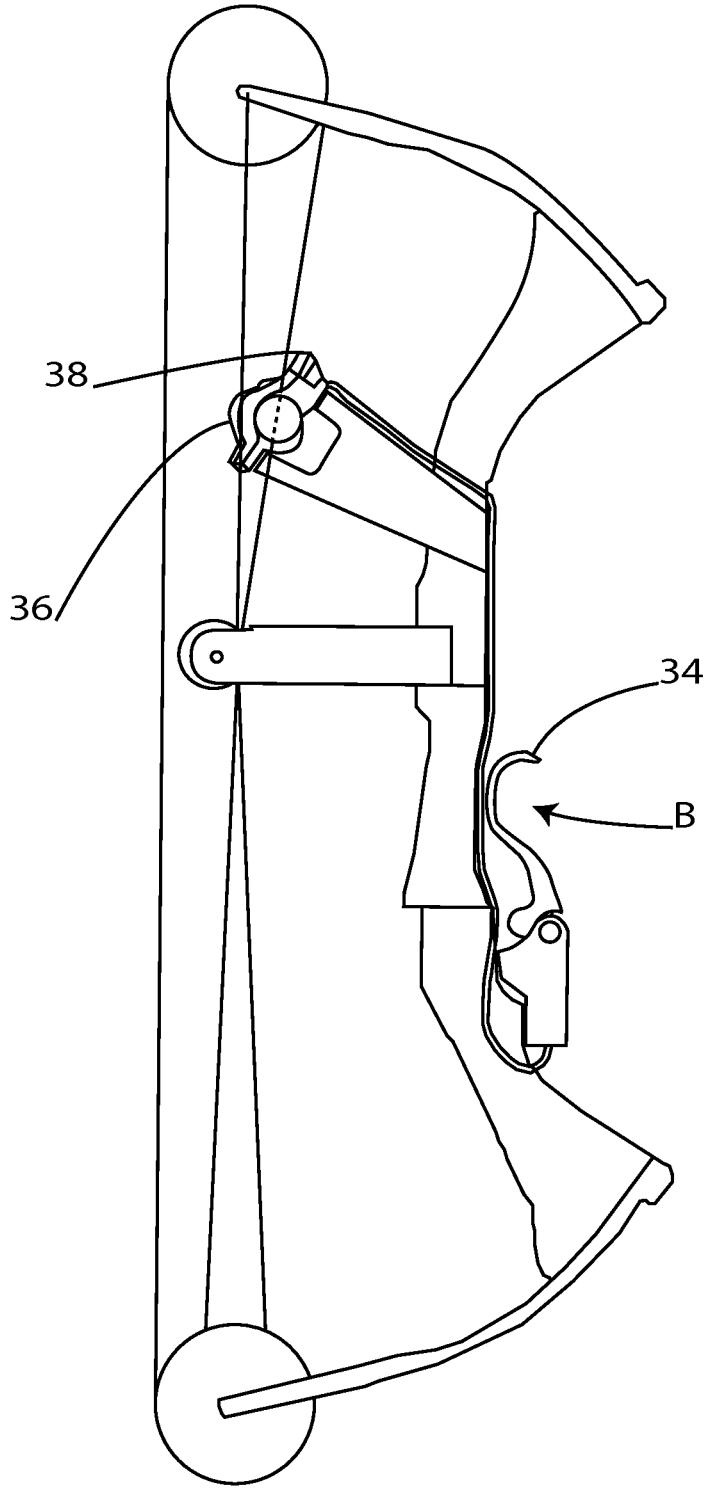
FIG. 2 is a perspective view of a compound archery bow including an embodiment of the present invention in which the actuator is depressed thus actuating the brake on the cable of the bow.

FIG. 2 illustrates depression of the brake actuator 34 in the direction depicted by arrow B. When brake lever is depressed as shown in FIG. 2, the brake pads of the caliper 36 are pressed together thus imparting friction from opposing sides of the string 38 thus effectually braking the string. Ideally a user can actuate the brake mechanism when the user has the bow at full draw, thus preventing the string from moving and thus preventing the cams from rotating.

Figure 3:
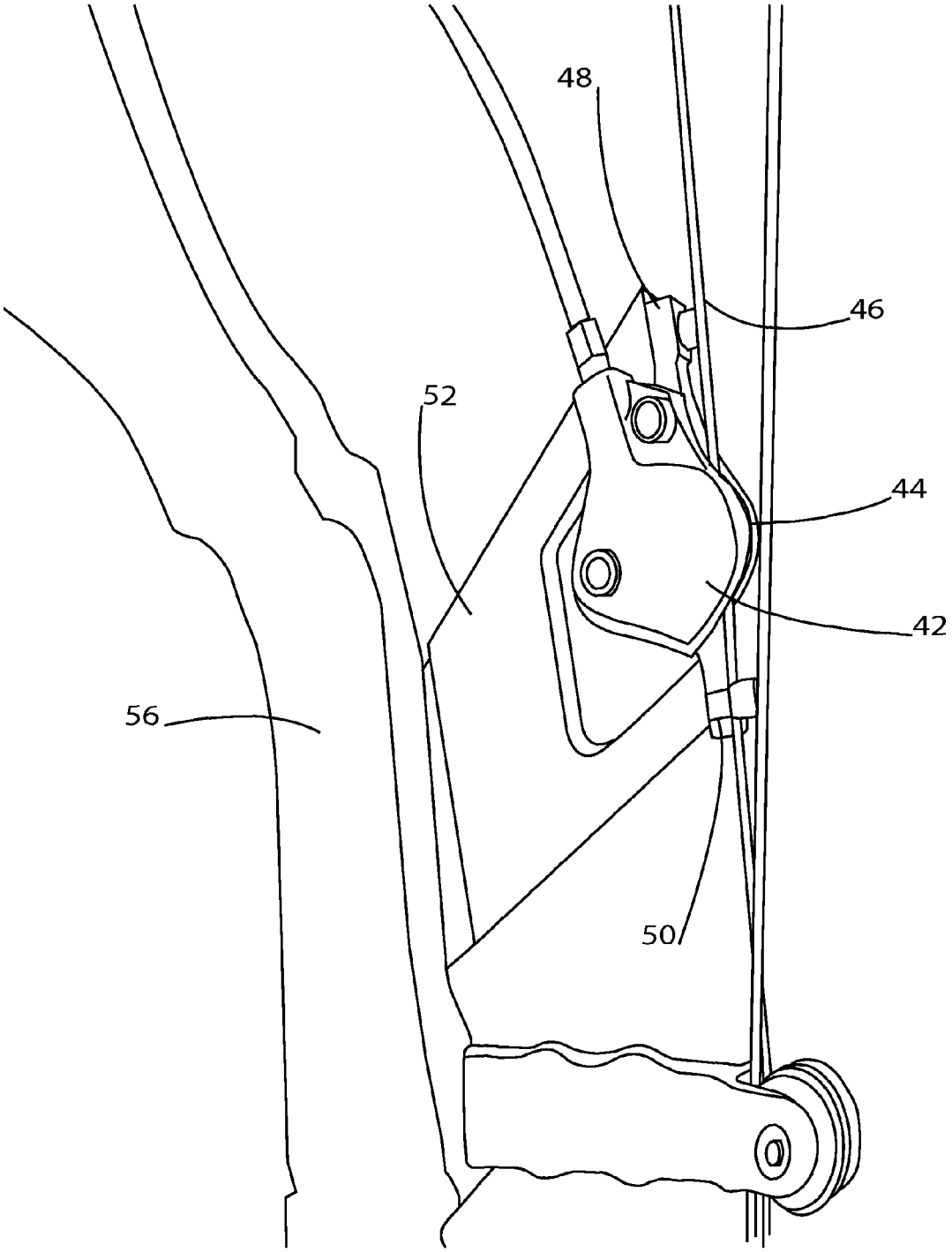
FIG. 3 is an enlarged view of an embodiment of a caliper of the invention positioned on the string of a compound archery bow.

FIG. 3 illustrates a magnified view of the braking mechanism of the present invention. Brake caliper 42 is attached to a bow mount 52 by a bracket 48 and mounting bolt 50. The bow mounting bracket 52 is connected to the bow riser 56. The caliper is attached to the bow such that the bow string 46 passes within a groove 44 of the caliper in which the opposing brake pads of the caliper are located. Alternatively, it is thought that a variety of mechanisms could be used to brake the string-without deviating from the present invention. Alternative braking mechanisms could include, for example, a device in which a 360 degree friction is placed upon the string or alternatively, any other friction placing device in which friction is placed onto the string from opposing sides of the string.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

The invention claimed is:

1. A compound archery bow, wherein said compound bow comprises:

a bow riser having two limbs;

a cam rotatably mounted on one of said limbs;

a bowstring strung between said limbs, said bowstring being windably connected with said at least one cam;

at least one string or cable(s) strung between said limbs, said at least one string or cable being windably connected with said at least one cam, wherein said bow is configured such that when a user draws said bowstring back the bowstring rotates said cam causing said string or cable to be wound out of said cam; and a brake comprising a brake actuation mechanism and a string friction mechanism, wherein said string friction mechanism is positioned on said string, wherein actuation of said brake actuation mechanism actuates said string friction mechanism to impart friction onto said string preventing said string from moving.

2. The compound archery bow of claim 1, wherein said string friction mechanism comprises a caliper comprising two opposing brake pads, wherein said caliper positioned such that said string is located between said two opposing brake pads of said caliper, wherein actuation of said brake actuation mechanism biases said opposing brake pads toward one another.

3. The compound archery bow of claim 1, wherein said brake actuation mechanism comprises a depressible lever handle.

4. The compound archery bow of claim 3, wherein said brake actuation mechanism is configured such that depression of said lever handle actuates said string friction mechanism.

5. The compound archer bow of claim 3, wherein said brake is configured such that said brake pads are biased toward one another in a biased position, wherein depression of said lever handle releases said brake pads from said biased position to release friction on said string.

6. The compound archery bow of claim 1, wherein said brake actuation mechanism is attached to said string friction mechanism by a hydraulic brake line.

7. The compound archery bow of claim 1, wherein said brake actuation mechanism is attached to said string friction mechanism by a mechanical brake line.

8. The compound archery bow of claim 1, wherein said brake actuation mechanism is attached to said string friction mechanism by an electrical connection.

9. The compound archery bow of claim 1, wherein said brake actuation mechanism is attached to said string friction mechanism by a wireless signal.

10. The compound archery bow of claim 1, wherein said string friction mechanism attached to said riser.

11. The compound archery bow of claim 1, wherein said string friction mechanism comprises a mounting attachment, wherein said mounting attachment is attached to said riser.

12. The compound archery bow of claim 1, wherein said brake actuation mechanism is a depressible trigger.

13. The compound archery bow of claim 1 wherein said bow handle comprises a grip section, wherein said brake actuation mechanism is attached to said bow riser proximate to said grip.

14. The compound archery bow of claim 13, wherein said brake actuation mechanism comprises a depressible lever, wherein said depressible lever is positioned on said bow handle on an opposite side of said bow handle from said bowstring.

15. The compound archery bow of claim 14, wherein said lever is biased away from said bow handle, wherein depression of said lever toward said bow handle actuates said cable friction mechanism to impart friction on said string.

16. The compound archery bow of claim 14, wherein said lever is biased away from said bow handle, wherein depression of said lever toward said bow handle releases said string friction mechanism from imparting friction on said string.

17. A compound archery bow, wherein said compound archery bow comprises:

a bow riser having two limbs;

a cam rotatably mounted on one of said limbs;

a bowstring strung between said limbs, said bowstring being windably connected with said at least one cam;

at least one string or cable strung between said limbs, said at least one string or cable being windably connected with said at least one cam, wherein said bow is configured such that when a user draws said bowstring back the bowstring rotates said cam causing said cable to be wound out of said cam; and a brake comprising a brake caliper and an actuation device configured to actuate said caliper, wherein said caliper comprising two opposing brake pads, wherein said caliper positioned such that said string is located between said two opposing brake pads of said caliper, wherein actuation of said brake actuation mechanism biases said opposing brake pads toward one another to impact friction on opposite sides of said string.

18. The compound archery bow of claim 17, wherein said actuation device comprises a depressible brake lever.

19. The compound archery bow of claim 18, wherein said depressible brake lever is configured such that depressing said brake lever biases said brake pads of said brake caliper together to impart friction on said string.

* * * * *